United States Patent [19]

Weinert

[11] 4,398,362

[45] Aug. 16, 1983

[54] OCEANIC SEAPLOW SYSTEM

[76] Inventor: Friedrich Weinert, 219-19-131st Ave., Jamaica, N.Y. 11413

[21] Appl. No.: 409,160

[22] Filed: Aug. 18, 1982

[51] Int. Cl.[3] ..... E02F 3/88

[52] U.S. Cl. ..... 37/61; 37/66; 37/189; 37/DIG. 8; 417/73

[58] Field of Search ..... 37/DIG. 8, 58, 54, 66, 37/70, 189, 1, 195, 94; 417/73, 74, 75; 299/8

[56] References Cited

U.S. PATENT DOCUMENTS

| | | | |
|---|---|---|---|
| 3,433,531 | 3/1969 | Koot et al. | 37/DIG. 8 |
| 3,672,725 | 6/1972 | Johnson | 37/DIG. 8 |
| 3,765,727 | 10/1973 | Santangelo et al. | 37/DIG. 8 |
| 3,776,593 | 12/1973 | Kuhlmann-Schaefer et al. | 37/DIG. 8 |
| 3,787,144 | 1/1974 | Wood | 37/1 X |
| 3,897,173 | 7/1975 | Mandroian | 417/73 |
| 3,971,593 | 7/1976 | Porte et al. | 37/DIG. 8 |

FOREIGN PATENT DOCUMENTS

| | | | |
|---|---|---|---|
| 22071 | 4/1935 | Australia | 37/189 |
| 140265 | 2/1980 | Fed. Rep. of Germany | 37/DIG. 8 |
| 510447 | 9/1920 | France | 37/1 |
| 1468199 | 3/1977 | United Kingdom | 37/DIG. 8 |

*Primary Examiner*—Clifford D. Crowder

[57] ABSTRACT

An oceanic seaplow system comprising a plurality of vessels forming a mini fleet wherein a flexible hose is joined at one end to a suction turbine associated with a mothership and the other end is connected to a suction stud on a seaplow travelling on the ocean bottom. Assistant vessels raise and lower the flexible hose and the seaplow by cables. One of the assistant vessels supplies air to an injector in the flexible hose through a pressure hose at one or more points for second stage acceleration of the dredged material. First stage acceleration takes place inside the seaplow through an electrolysis pump. Electricity for electrolysis and for the steering system is supplied through electric cables from one of the assistant vessels. The seaplow converts the forward motion of the plow by surface contact into rotation of plow elements in order to dig up specimens for elevation by the electrolysis pump located within the seaplow. The material dredged is accelerated through the flexible hose by the air injectors into the suction tubine and to the mothership for processing.

6 Claims, 4 Drawing Figures

OCEANIC SEAPLOW SYSTEM

This invention is related to a previous invention called "Power Wheel" U.S. Pat. No. 4,340,970. This invention introduces a sea plow able to collect minerals from the ocean floor, such as manganese nodules or crystals like diamonds etc. Crystals are lighter and bigger than sand grain and therefore, lay on top of the sand surface depending on the sea current, meaning without current organic matter like mud would cover the precious gems. So depending on the sea current and location of these crystals they can be scooped up from above sea level, meaning this invention is designed to scoop up everything loose above or on the sea bed as long as the object fits the opening of the suction hose. The system consists of a mother ship able to lower the sea plow with the attachment hose to the sea bed and drag it. The mother ship has a powerful suction device in the form of a water turbine installed at the top of the flexible hose to accelerate the contents inside the hose. Additionally, high compressed air produced above sea level guided through a high pressure hose deep into the ocean to penetrate at least at one point of the flexible hose to inject air in an upward direction called second stage. First stage is creating inside the sea plow by a pressure cell which produces hydrogen and oxygen gases by electrolysis and ignites these gases in intervals, whereby the fast expanding gases are injected in an upward direction inside the sea plow which opening is connected to the flexible hose. The uprising of the gas bubbles will elevate the contents inside the hose to the surface into the mother ship. In my calculation, a steel ball with a volume of one cubic yard and one inch thick walls filled with atmospheric pressurized air released from the sea ground 20 thousand feet below sea level will accelerate fast enough to penetrate the atmosphere and enter into space to orbit the earth. This example should explain the force created when gas bubbles are released deep on the ocean floor inside a hose. The maneuvering of the sea plow can be achieved by one or more ships. A mini fleet consisting of a mother ship and two smaller vessles. The hose from the sea plow is attached to a suction turbine on the mother ship which will process the contents from the hose, as the second vessel has a cable winding around a winch fastened to the hose in such a fashion that the winch can raise or lower the hose under water. Additionally, compressed air produced by a compressor inside the ship and directed through a pressure hose also winding around a winch and penetrating the flexible hose at least at one point to accelerate the contents in the hose into second stage. The third vessel also runs a cable over a drum of a winch whereby one end of the cable is fastened around the joint of the flexible hose and the stud of the plow. Therefore, the vessel connected to the plow will drag the plow and also will supply the electricity needed for the electrolysis taking place inside the plow. The two assistant vessels are towed by the mother ship through a towline in order to keep the exact distance. The seaplow rides on several wheels, whereby the center wheel resembles a plow disc consisting of several flexible wheel spokes in form of a curved flat bar with digging pockets installed in between. The digging pockets will dig up from the ocean floor and direct the contents from the digging pockets into the opening of suction channel which is connected to the flexible hose. The suction action of the suction channel will scoop up everything in close range. To prevent clogging of the suction opening disc saw blades are installed around a shaft which is rotated by a belt or chain around the pulley of the plow disc. Meaning the motion of the plow will rotate the disc saw lined up in formation of a grill. Therefore, larger objects will be cut into pieces or thrown away from the opening. Comparing a volcanic eruption on land with a volcanic eruption in the deep sea, we will realize that the elementary forces are amplified thousands of times over, this forces entire different minerals are produced far more colorful than diamonds found on land. Diamonds are the products of gigantic mass collision compressed into its elementary purity. Gold is the product of billions of years of star evolution. I wonder if people realize the value of heavy metals. Nuclear physicists do. They have realized the potential of these metals. And yet, already misuse them. Therefore, the treasures of the sea belong to the explorer, a gift from mother earth to its admirer, because it takes the touch of a lover, the courage of a sailor and the endurance of an Olympian to reach these treasures. I have touched nature all my life and the courage of any sailor, but no more strength of an Olympian. But I do know exactly where these treasures are hidden. Further objects and advantages of this invention will be apparent from the following description of the invention.

SUMMARY OF THE INVENTION

Sea plow in connection with a oceanic scooping devices or system. Oceanic mining comes in two different versions. One version is ground mining to collect sediments penetrating the ocean floor. The second version consists of oceanic floor mining, meaning collecting everything on the ocean floor and above it. This is exactly what the present invention is designed for. A sea plow is dragged on the ocean floor by means of a flexible hose which contents is accelerated by releasing gas bubbles inside the plow through electrolysis and air injections along the flexible hose supplied from above the surface. The hose is pulled by one or more vessels, whereby the mother ship collects the contents of the flexible hose and processes it. The purpose of the assistant vessels is to handle flexible hose which could have a length of over 50,000 feet to reach the bottom of the Mariana Trench. By such a length the hose cannot be handled with one winch and therefore, two assistant vessels are needed so several cables at several points can maneuver the flexible hose precisely as it is needed. The functioning of the sea plow is to lower the flexible hose to the sea bed. Wheels on the plow will track the surface and elevate loose lumps, rocks, or gems into the opening of the suction hose. Additionally, manganese nodules in any size can be scooped up at the same time. Naturally the plow can also be raised above sea bed to collect fertile sea water with its organic life form.

DETAILED DESCRIPTION OF A PREFERRED EMBODIMENT

Figure 1:
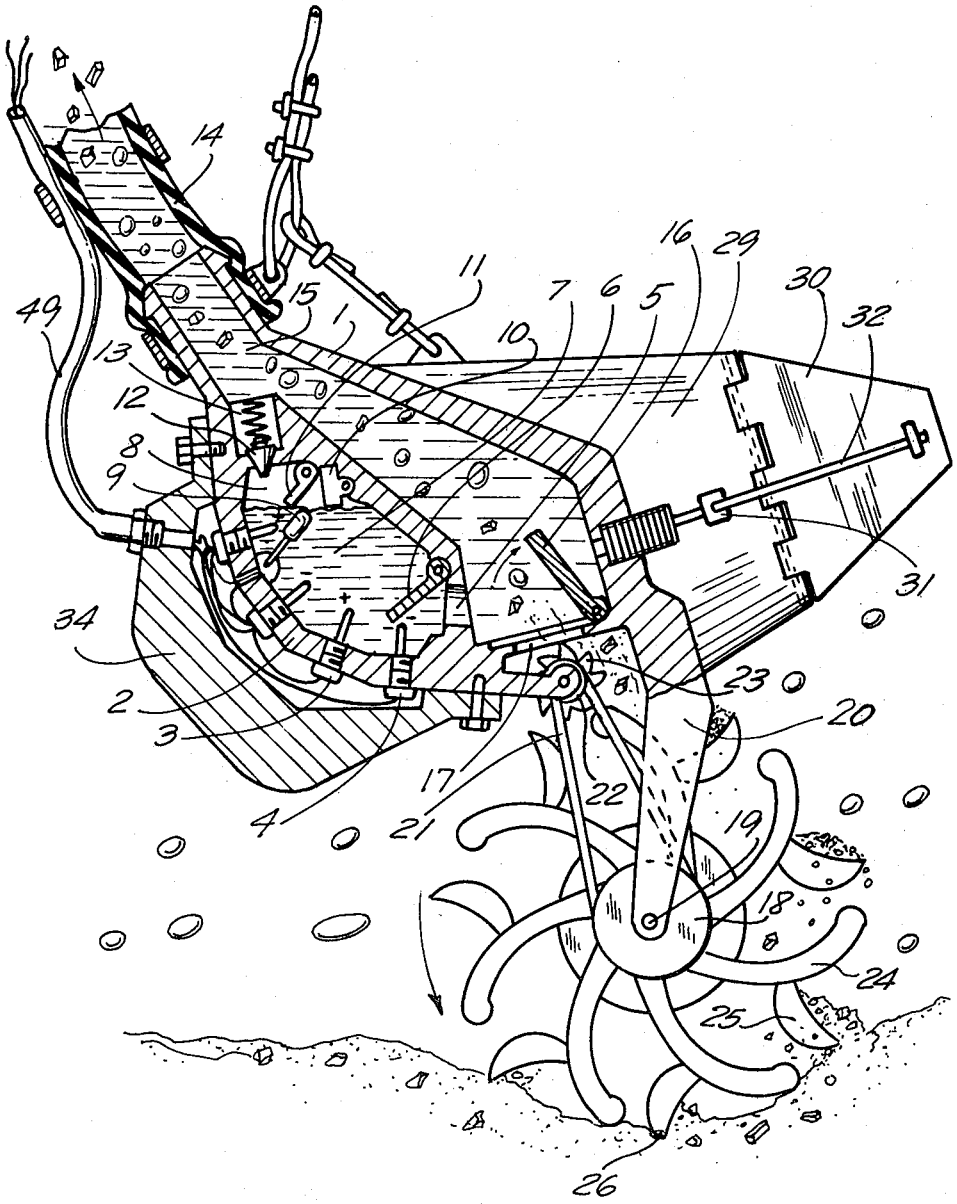
FIG. 1 is a partly sectional explanatory view of a sea plow operating on the ocean floor with an electrolysis pressure chamber in a relaxed stage.
Figure 2:
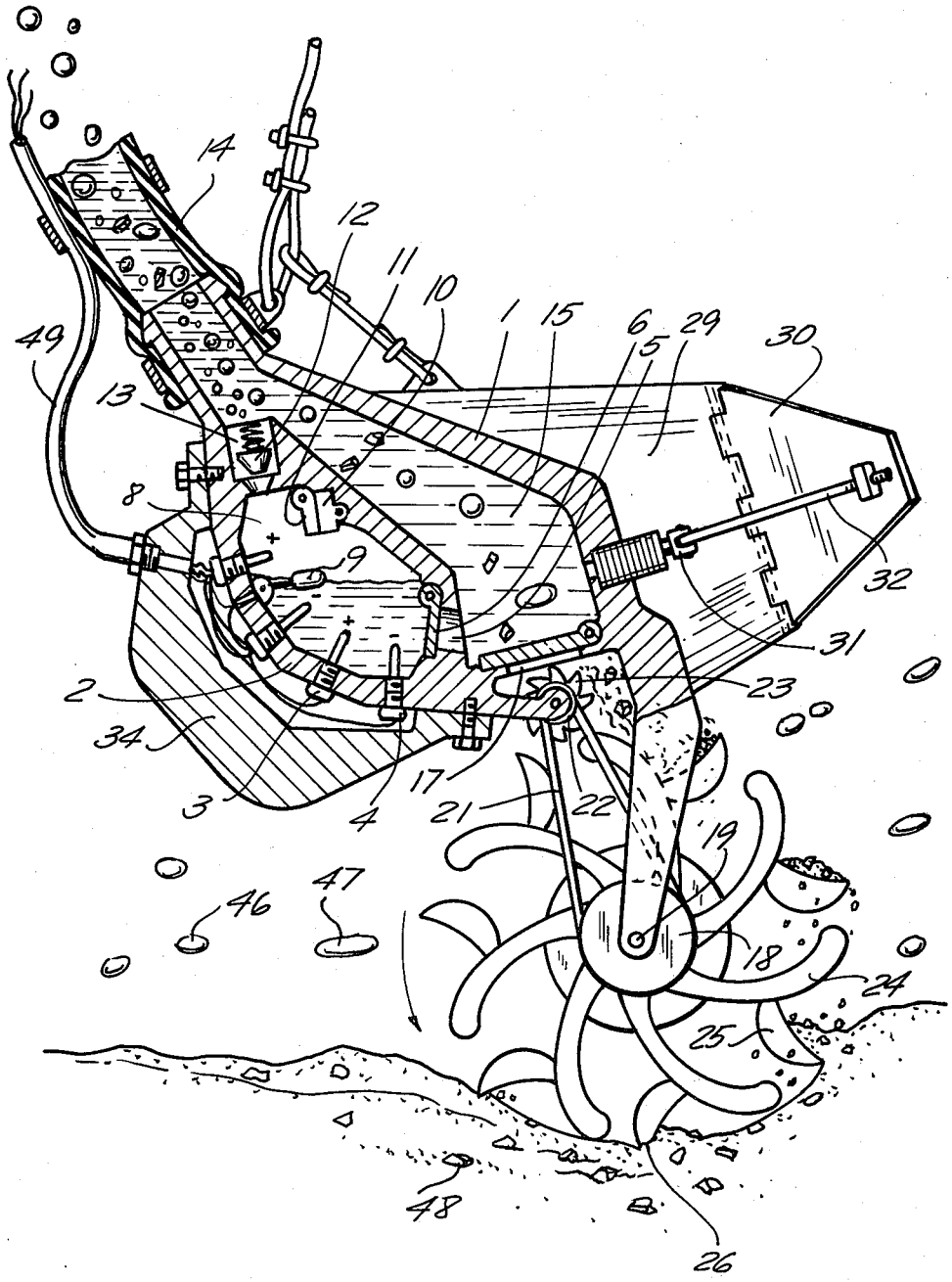
FIG. 2 is a partly sectional explanatory view of a sea plow operating on the ocean floor with an electrolysis pressure chamber under combustion.
Figure 3:
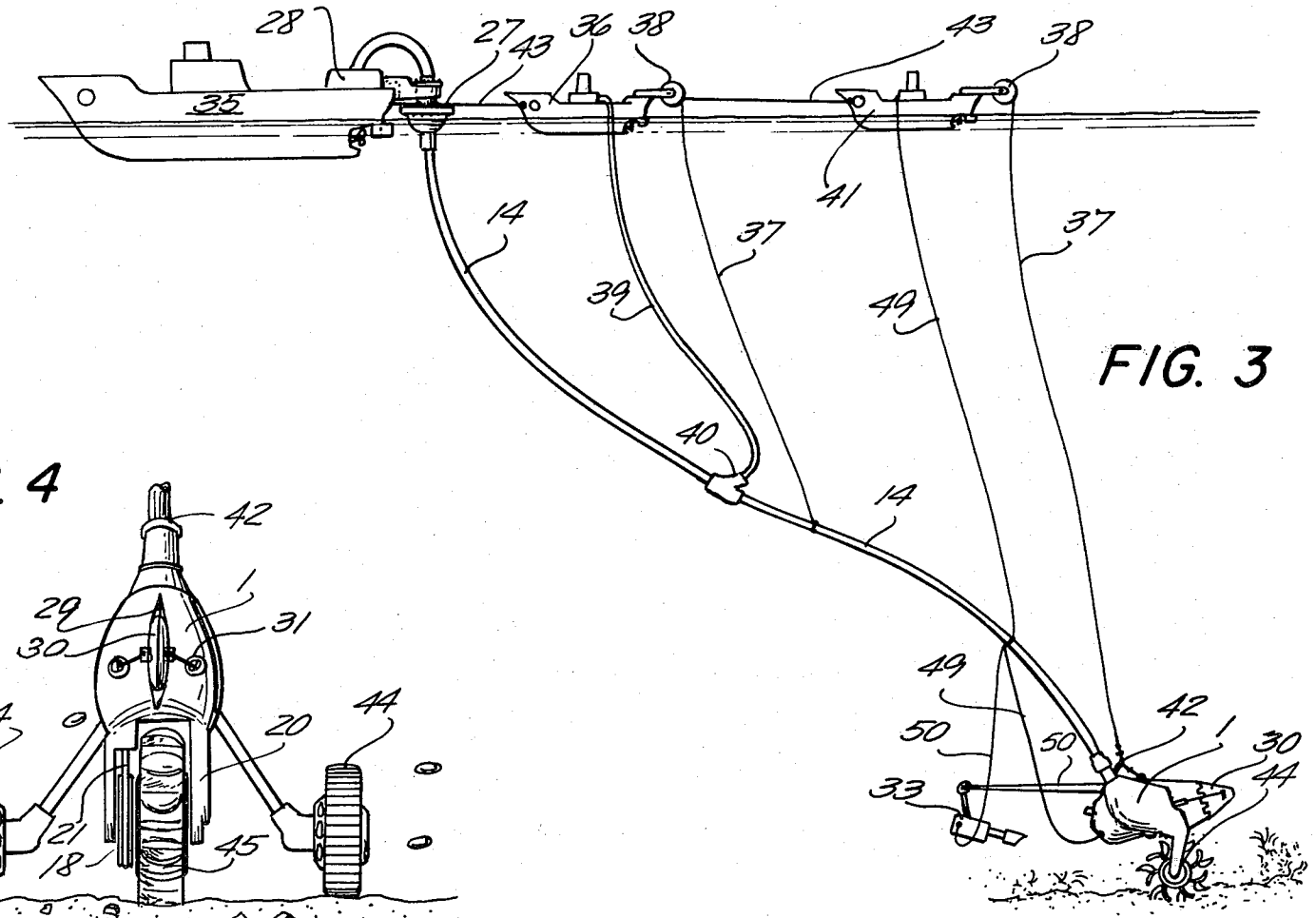
FIG. 3 is an explanatory plan view of the sea plow scooping device or system.
Figure 4:
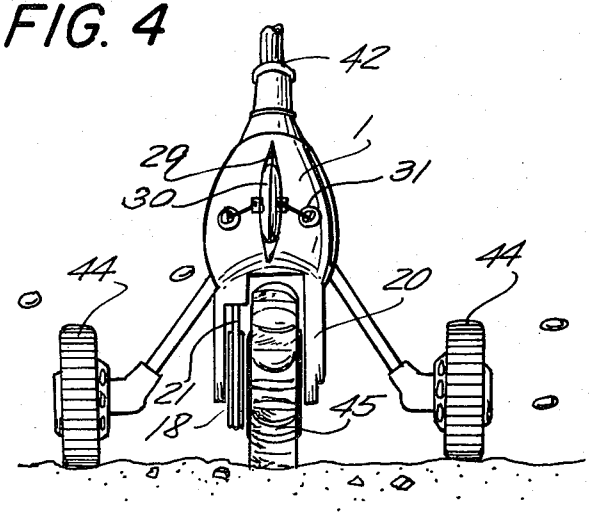
FIG. 4 is a rear plan view of the sea plow.

Referring to FIGS. 1-2 there is shown a sectional explanatory view of a sea plow of the present invention. The sea plow consists of a heavy body resting on wheels and moved through the pull of a flexible hose connected to a vessel on the surface and the other end to the sea plow. The sea plow consists of a hollow vessel FIG. 1 (1). The vessel is divided into two chambers, one chamber (2) is used to separate hydrogen and oxygen from the sea water through anode (3) and cathode (4). The process is called electrolysis. In relaxed stage the sea water will enter through water channel (5) by lifting flap valve (6) to enter into pressure cell (7). Electric currency admitted by anode (3) and collected by Cathode (4) will produce oxygen and hydrogen gas mixture which is trapped at the highest point (8) inside the pressure cell (7). After a certain amount of gases are produced, the water level inside the pressure cell will drop so float valves (9) will automatically switch on magnet (10) with such a force that hydrogen trapped in between the igniter valve FIG. 2 (11) and magnet (10) will explode by forcing valve plunger of one way valve (12) upward so the expanding gases inside the pressure cell can escape through jet opening (13) into the flexible hose (14). Therefore, the gas expansion inside the pressure cell is transmitted through shock waves throughout suction channel (15) which automatically closes flap valve (16) so the entire gas heat expansion is trapped inside sea plow (1) with the products of a powerful jet stream which can only move upwards inside suction channel (15) through flexible hose (14) into a vessel above the water surface. After the impulse created by explosion the upward stream of the liquid contents will lift up flap valve (16) as shown in FIG. 1 and therefore, scoop up everything loose close to opening (17) called relaxed stage whereby sea water enters through water channel (5) into pressure cell (7) which will raise the water level and so float valve (9) which automatically shuts off the current to magnet (10) which will release the igniter flap (11) and close valve plunger (12) as shown in FIG. 1. The plow disc consists of a wheel hub (18) which is centralized by an axis (19) joined to a flexible frame (20). The wheel hub is used as a pulley to drive belt or chain (21) to a second pulley (22) which rotates a disc saw (23) in front of opening (17) in such a fashion that depending on the size of the opening, a series of disc saws can be installed instead of a grill by cutting larger pieces to make them fit for the opening (17) or reject them by flicking them off by the rotation of the disc saw. The plow disc in FIGS. 1 & 2 shows a plurality of flexible spikes curved in driving direction as a dipper spoon mounted at the back of the spokes extending slightly with a sharp edge outside the circumference of the wheel so the spoon edge (26) will dig up specimens from the ocean floor and elevate the specimens by the rotation of the wheel to opening (17) whereby the specimens are scooped up by the jet stream through suction channel (15) into flexible hose (14) and through a suction turbine FIG. 3 (27) on board ship where the specimens are separated by a separator (28) to be processed. At the rear of the sea plow fins (29) are installed to direct the plow by a rudder blade (30) which can be remote controlled from above the surface by an electric contact which activates a right or a left solenoid (31) one at a time installed on either side of the center fin (2) connected through a cable (32). The entire operation of raising or lowering the plow and changing directions can be observed by an underwater T.V. camera FIG. 3 (33). To increase the weight of the sea plow a changeable counter weight FIGS. 1-2 (34) is installed. FIG. 3 shows an explanatory plan view of the entire operation, meaning mother ship (35) sucks up the contents of flexible hose (14) through a turbine pump (27) and a separator (28) to process the contents. Assistant vessel (36) runs a cable (37) over a winch (38) to raise or lower flexible hose (14). Air pressure on board of the vessel will compress air which is directed through an air pressure hose (39) into the flexible hose in an upward direction through jet (40) called second stage as first stage gas injection takes place inside sea plow (1) by electrolysis. Assistant vessel (41) runs a cable over a winch drum (38) which is fastened around the collar connecting the flexible hose with suction channel (42) of sea plow (1). The assisting vessels are towed by the mother ship by two cable (43) in order to keep precise distance. FIG. 4 shows a rear plan view of the sea plow (1), with two support wheels (44) and plow wheel (45) indicating wheel pulley (18) and frame (20) and neck collar (42) and steering fin (29) and rudder blade (30). In drawing FIGS. 1-2, manganese nodule are shown floating in water. The manganese nodule comes in different sizes depending on the location in the ocean. FIG. 2 (46) show manganese in the size of a golf ball, (47) shows manganese nodule in size of sausages (48) show crystal size of gems. FIG. 3 (49) shows the electric supply cable.

While there have been shown and described and pointed out the fundamental features of a sea plow in connection with a three stage water and gas acceleration inside a flexible hose whereby the entire operation is conducted by a mother ship with one or more assistant vessels called scooper mini fleet designed for oceanic deep sea mining. It will be understood that various omissions and substitutions and changes in the form and detail of the device illustrated and in its detail may be made by those skilled in the art without departing from spirit of the invention. It is the intention therefore, to be limited only as indicated by the scope of the following claim.

What is claimed is:

1. An oceanic seaplow system comprising a plurality of vessels forming a minifleet consisting of a mothership and at least one assistant vessel, a suction turbine mounted adjacent the mothership, a flexible hose having one end connected to the turbine and the other end connected to a suction stud on a seaplow, winch and cable means connecting said hose and said seaplow to said at least one assistant vessel for raising and lowering, at least one air injection means for said hose positioned between said turbine and said seaplow for second stage acceleration, air being delivered to said air injection means by an air pressure hose connected to one of said vessels, means inside said seaplow for creating first stage acceleration by forming gas bubbles by means of electrolysis, a steering system for said seaplow comprising a mobile fin activated by solenoids, an observation T.V. camera mounted on said seaplow in such a fashion that it can be tracked by the mothership as the assistant vessel controls the flexible hose and raises or lowers and steers the seaplow, electric cables connected to and controlled from one of said vessels for supplying power for said electrolysis, said steering system and said T.V. camera, said seaplow comprising a rotatable wheel having a plurality of curved flexible spokes equipped with dipper spoons at the rear of each spoke extending outside of the circumference of the spokes, said wheel converting forward motion and contact with the seabed into rotation in order to dig up specimens which are elevated through rotation of the wheel introduced by surface contact and forward torque of the wheel, a suction opening in said seaplow adjacent said wheel, whereby the contents of the dipper spoons are fed to said suction opening which sucks up all specimens in close range to direct them with the upward current inside the flexible hose in a three stage acceleration including the first stage gas bubble acceleration introduced by electrolysis, the second stage air injection and the third stage suction turbine, and means on board one of the vessels to collect the contents of the hose to be processed.

2. An oceanic seaplow system as recited in claim 1 wherein said seaplow is pulled over the ocean floor by one of said vessels by means of said flexible hose connecting said vessel with the seaplow.

3. An oceanic seaplow system as recited in claim 2 wherein said means inside said seaplow for creating first stage acceleration by forming gas bubbles by means of electrolysis is at the lowest point of the flexible hose and comprises a pressure cell containing electrodes for forming hydrogen and oxygen gas from seawater, whereby said oxygen and hydrogen gas mixture is stored in said pressure cell, an electromagnetic shock device for igniting said gases, and a pressure valve in said chamber for releasing the expanding gases into the flexible hose to increase the upward current inside the hose.

4. An oceanic seaplow as recited in claim 3 wherein said mobile fin activated by solenoids can be moved from the right to the left, from the left to the right or kept in center.

5. An oceanic seaplow as recited in claim 4 wherein said wheel comprises a central axis supported by the seaplow, a hub connecting said plurality of curved flexible spokes for rotation about said axis, a pulley on said hub, a second pulley mounted at the suction opening of the seaplow, a belt connecting said pulleys, said second pulley mounted coaxially with a series of disc saws spaced along the suction opening whereby rotation of said wheel rotates said saws to control the size of material entering said opening.

6. An oceanic seaplow as recited in claim 5 wherein said mothership tows said at least one assistant vessel.

* * * * *